US006043201A

United States Patent [19]

Milbrath et al.

[11] Patent Number: 6,043,201

[45] **Date of Patent: *Mar. 28, 2000**

[54] COMPOSITION FOR CUTTING AND ABRASIVE WORKING OF METAL

[75] Inventors: Dean S. Milbrath, Stillwater; Mark W. Grenfell, Woodbury; Daniel D. Krueger, Stillwater; Richard M. Flynn, Mahtomedi; Frederick E. Behr, Woodbury, all of Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,207

[22] Filed: Sep. 17, 1996

[51] Int. Cl.[7] ..... C10M 131/08

[52] U.S. Cl. ..... 508/582; 508/250; 508/268; 508/307; 508/545; 72/42

[58] Field of Search ..... 508/582, 250, 508/268, 307, 545; 72/42

[56] References Cited

U.S. PATENT DOCUMENTS

| | | | |
|---|---|---|---|
| 3,129,182 | 4/1964 | McLean | 252/54 |
| 3,280,027 | 10/1966 | Pierre et al. | 252/45 |
| 3,365,397 | 1/1968 | Kolarik | 252/33.6 |
| 3,756,052 | 9/1973 | Quaal et al. | 252/49.3 |
| 3,946,083 | 3/1976 | Delaunois et al. | 508/582 |
| 4,224,173 | 9/1980 | Reick | 252/52 A |
| 4,428,851 | 1/1984 | Hisamoto et al. | 252/58 |

(List continued on next page.)

FOREIGN PATENT DOCUMENTS

| | | | |
|---|---|---|---|
| 0 412 788 | 2/1991 | European Pat. Off. | C10M 173/02 |
| 0 553 437 | 8/1993 | European Pat. Off. | B23K 35/40 |
| 0 565 118 | 10/1993 | European Pat. Off. | C10M 107/38 |
| 1 403 628 | 8/1975 | United Kingdom | C10M 3/24 |
| WO 93/24586 | 10/1993 | WIPO | C09K 5/04 |
| WO96/22356 | 7/1996 | WIPO | C11D 7/50 |
| WO 97/35673 | 10/1997 | WIPO | B21B 45/02 |

OTHER PUBLICATIONS

Jean C. Childers, The Chemistry of Metalworking Fluids, Metal–Working Lubricants, pp. 165–189 (Jerry P. Byers ed., 1994) Month unavailable.

Pamela S. Zurer, Looming Ban on Production of CFCs, Halons Spurs Switch to Substitutes, Chem. & Eng'g News, Nov. 15, 1993 pp. 12–18.

Fluorinert™ Electronic Fluids, product bulletin 98–0211–6086(212)NPI, issued Feb. 1991, available from 3M Co., St. Paul, Minn.

Betzalel Avitzur, Metal Forming, Encyclopedia of Physical Science and Technology, vol. 9, pp. 652–682 (Academic Press, Inc. 1992) Month unavailable.

Leigh Mummery, Surface Texture Analysis the Handbook, Chpt. 3, pp. 26–31 and 46–51 (Hommelwerke GmbH 1990) Month unavailable.

E. Paul DeGarmo et al., The Fundamentals of Metal Forming, Materials and Processes in Manufacturing, 7th ed., pp. 394–408 (Macmillan Publishing Co. 1988) Month unavailable.

*Primary Examiner*—Jacqueline V. Howard
*Attorney, Agent, or Firm*—Lisa M. Fagan; John A. Burtis

[57] ABSTRACT

In one aspect, this invention provides a composition for the cutting and abrasive treatment of metals and ceramic materials comprising a hydrofluoroether. In another aspect, the present invention provides a method of cutting and abrasively treating metals and ceramic materials comprising applying to the metal or ceramic workpiece and tool a composition comprising a hydrofluoroether.

11 Claims, 1 Drawing Sheet

U.S. PATENT DOCUMENTS

| | | | |
|---|---|---|---|
| 4,430,234 | 2/1984 | Hasegawa et al. | 252/49.5 |
| 4,492,641 | 1/1985 | Buchwald et al. | 252/48.4 |
| 4,497,720 | 2/1985 | Moriga et al. | 508/582 |
| 4,559,153 | 12/1985 | Baldwin et al. | 252/48.6 |
| 4,639,323 | 1/1987 | Liao | 252/32.5 |
| 4,659,488 | 4/1987 | Vinci | 252/33 |
| 4,736,045 | 4/1988 | Drakesmith et al. | 549/380 |
| 4,885,414 | 12/1989 | Schweighardt et al. | 570/130 |
| 4,983,229 | 1/1991 | Tull | 148/246 |
| 5,032,306 | 7/1991 | Cripps | 252/68 |
| 5,091,104 | 2/1992 | Van Der Puy | 252/171 |
| 5,146,014 | 9/1992 | Graybill et al. | 570/131 |
| 5,154,845 | 10/1992 | Williams | 508/582 |
| 5,198,139 | 3/1993 | Bierschenk et al. | 252/68 |
| 5,211,861 | 5/1993 | Lafratta et al. | 252/33.6 |
| 5,393,442 | 2/1995 | Buchwald et al. | 252/54 |
| 5,476,974 | 12/1995 | Moore et al. | 508/582 |
| 5,547,593 | 8/1996 | Sanechika et al. | 508/207 |
| 5,605,882 | 2/1997 | Klug et al. | 510/411 |
| 5,676,005 | 10/1997 | Balliett | 72/42 |

COMPOSITION FOR CUTTING AND ABRASIVE WORKING OF METAL

FIELD OF THE INVENTION

This invention relates to metal working operations, particularly to metal cutting or abrasive metal working operations, and more particularly it relates to cooling and lubricating fluids used in conjunction with such operations.

BACKGROUND OF THE INVENTION

Metalworking fluids long have been used in the cutting and abrasive working of metals. In such operations, including cutting, milling, drilling, and grinding, the purpose of the fluid is to lubricate, cool, and to remove fines, chips and other particulate waste from the working environment. In addition to cooling and lubricating, these fluids also can serve to prevent welding between a work piece and tool and can prevent excessively rapid tool wear. See Jean C. Childers, *The Chemistry of Metafworking Fluids*, in METAL-WORKING LUBRICANTS (Jerry P. Byers ed., 1994).

A fluid ideally suited as a coolant or lubricant for cutting and abrasive working of metals and ceramic materials must have a high degree of lubricity. It must also, however, possess the added advantage of being an efficient cooling medium that is non-persistent in the environment, is non-corrosive (i.e., is chemically inert), and does not leave a residue on either the working piece or the tool upon which it is used.

Today's state of the art working fluids fall generally into two basic categories. A first class comprises oils and other organic chemicals that are derived principally from petroleum, animal, or plant substances. Such oils commonly are used either straight (i.e., without dilution with water) or are compounded with various polar or chemically active additives (e.g., sulfurized, chlorinated, or phosphated additives). They also are commonly solubilized to form oil-in-water emulsions. Widely used oils and oil-based substances include the following general classes of compounds: saturated and unsaturated aliphatic hydrocarbons such as n-decane, dodecane, turpentine oil, and pine oil; naphthalene hydrocarbons; polyoxyalkylenes such as polyethylene glycol; and aromatic hydrocarbons such as cymene. While these oils are widely available and are relatively inexpensive, their utility is significantly limited; because they are most often nonvolatile under the working conditions of a metalworking operation, they leave residues on tools and working pieces, requiring additional processing at significant cost for residue removal.

A second class of working fluids for the cutting and abrasive working of metals includes chlorofluorocarbons (CFCs), hydrochlorofluorocarbons (HCFCs), and perfluorocarbons (PFCs). Of these three groups of fluids, CFCs are the most useful and are historically the most widely employed. See, e.g., U.S. Pat. No. 3,129,182 (McLean). Typically used CFCs include trichloromonofluoromethane, 1,1,2-trichloro-1,2,2-trifluoroethane, 1,1,2,2-tetrachlorodifluoroethane, tetrachloromonofluoroethane, and trichlorodifluoroethane. The most useful fluids of this second general class of metal working fluids (CFCs & HCFCs) possess more of the characteristics sought in a cooling fluid, and while they were initially believed to be environmentally benign, they are now known to be damaging to the environment. CFCs and HCFCs are linked to ozone depletion (see, e.g., P. S. Zurer, *Looming Ban on Production of CFCs, Halons Spurs Switch to Substitutes*, CHEM. & ENG'G NEWS, Nov. 15, 1993, at 12). PFCs tend to persist in the environment (i.e., they are not chemically altered or degraded under ambient environmental conditions).

SUMMARY OF THE INVENTION

Briefly, in one aspect, this invention provides a composition for the cutting and abrasive treatment of metals and ceramic materials comprising a hydrofluoroether. In another aspect, the present invention provides a method of cutting and abrasively treating metals and ceramic materials comprising applying to the metal or ceramic workpiece and tool a composition comprising a hydrofluoroether.

The hydrofluoroether fluids used in the cutting and abrasive treatment of metals and ceramics in accordance with this invention provide efficient cooling and lubricating media that fit many of the ideal characteristics sought in a working fluid: These fluids efficiently transfer heat, are volatile, are non-persistent in the environment, and are non-corrosive. They also do not leave a residue on either the working piece or the tool upon which they are used, thereby eliminating otherwise necessary processing to clean the tool and/or workpiece for a substantial cost savings. Because hydrofluoroether-containing working fluids reduce tool temperature during operation their use in many cases will also enhance tool life.

DETAILED DESCRIPTION OF PREFERRED EMBODIMENTS

Figure 1:
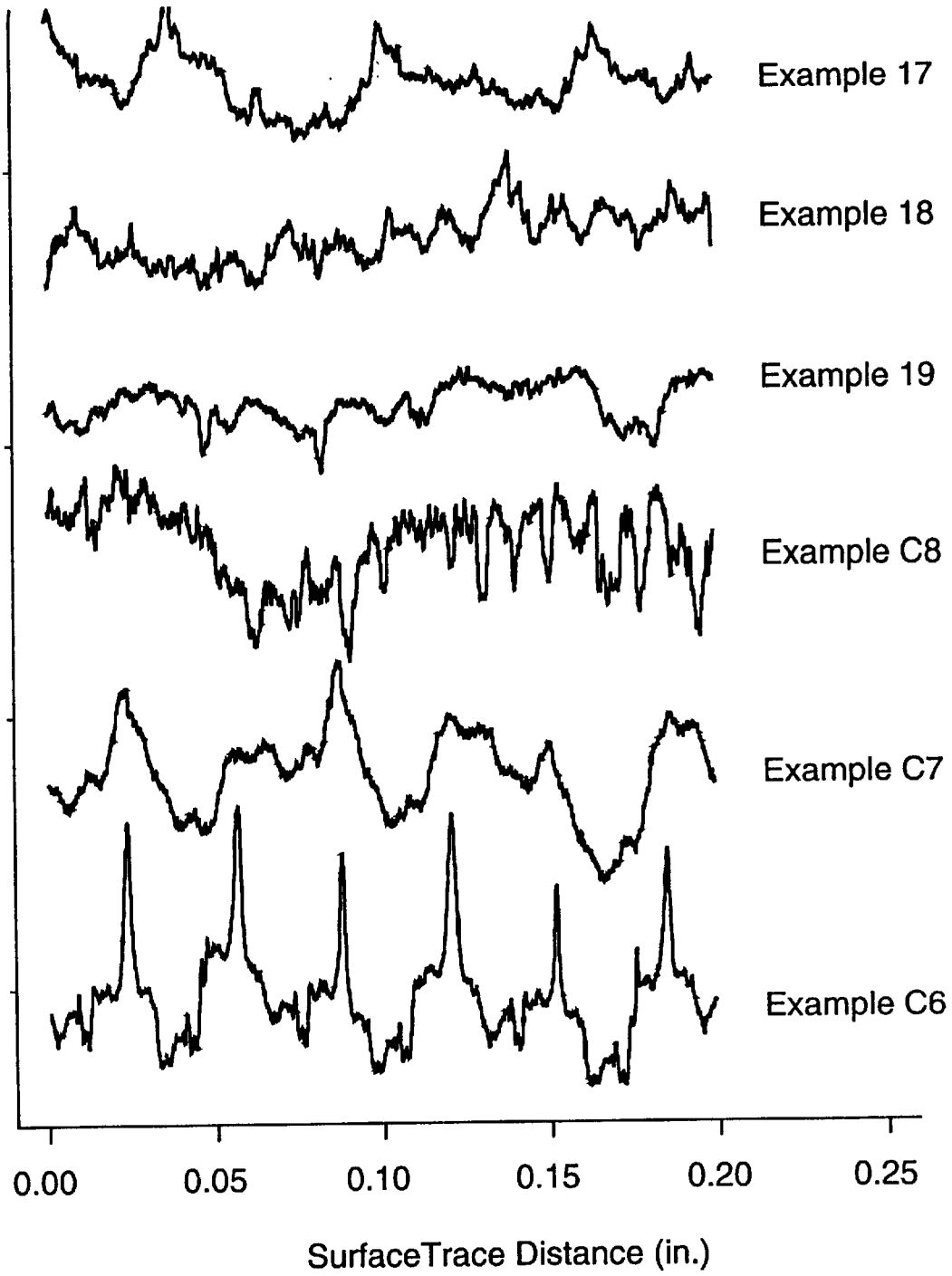
FIG. 1 provides profilometer traces of the surface of titanium endmilled using exemplary hydrofluoroether-containing compositions and comparative traces for titanium endmilled using conventional lubricating compositions.

The hydrofluoroether fluids of the invention may be utilized as cooling and lubricating working fluids in any process involving the cutting or abrasive treatment of any metal or ceramic material suitable to such operations. The most common, representative, processes involving the cutting, separation, or abrasive machining of metals include drilling, cutting, punching, milling, turning, boring, planing, broaching, reaming, sawing, polishing, grinding, tapping, trepanning and the like. Metals commonly subjected to cutting and abrasive working include: refractory metals such as tantalum, niobium, molybdenum, vanadium, tungsten, hafnium, rhenium, titanium; precious metals such as silver, gold, and platinum; high temperature metals such as nickel and titanium alloys and nickel chromes; and other metals including magnesium, aluminum, steel (including stainless steels), and other alloys such as brass, and bronze. The use of hydrofluoroether fluids in such operations acts to cool the machining environment (i.e., the surface interface between a workpiece and a machining tool) by removing heat and particulate matter therefrom. These fluids will also lubricate machining surfaces, resulting in a smooth and substantially residue-free machined metal surface.

The cooling and lubricating compositions of this invention comprise fluorinated ethers that may be represented generally by the formula:

$$(R_1—O)_n—R_2 \quad (I)$$

where, in reference to Formula I, n is a number from 1 to 3 inclusive and $R_1$ and $R_2$ are the same or are different from one another and are selected from the group consisting of substituted and unsubstituted alkyl, aryl, and alkylaryl groups and their derivatives. At least one of $R_1$ and $R_2$ contains at least one fluorine atom, and at least one of $R_1$ and $R_2$ contains at least one hydrogen atom. Optionally, one or both of $R_1$ and $R_2$ may contain one or more catenary or noncatenary heteroatoms, such as nitrogen, oxygen, or sulfur. $R_1$ and $R_2$ may also optionally contain one or more functional groups, including carbonyl, carboxyl, thio, amino, amide, ester, ether, hydroxy, and mercaptan groups. $R_1$ and $R_2$ may also be linear, branched, or cyclic, and may contain one or more unsaturated carbon-carbon bonds. $R_1$ or $R_2$ or both of them optionally may contain one or more chlorine atoms provided that where such chlorine atoms are present there are at least two hydrogen atoms on the $R_1$ or $R_2$ group on which they are present.

Preferably, the cooling and lubricating compositions of the present invention comprise fluorinated ethers of the formula:

$$R_f—O—R \quad (II)$$

where, in reference to Formula II above, $R_f$ and R are as defined for $R_1$ and $R_2$ of Formula I, except that $R_f$ contains at least one fluorine atom, and R contains no fluorine atoms. More preferably, R is a noncyclic branched or straight chain alkyl group, such as methyl, ethyl, n-propyl, iso-propyl, n-butyl, i-butyl, or t-butyl, and $R_f$ is a fluorinated derivative of such a group. $R_f$ preferably is free of chlorine atoms, but in some preferred embodiments, R contains one or more chlorine atoms.

In the most preferred embodiments, $R_1$ and $R_2$, or $R_f$ and R, are chosen so that the compound has at least three carbon atoms, and the total number of hydrogen atoms in the compound is at most equal to the number of fluorine atoms. Compounds of this type tend to be nonflammable. Representative of this preferred class of hydrofluoroethers include $C_3F_7OCH_3$, $C_3F_7OC_2H_5$, $C_4F_9OCH_3$, $C_4F_9OCH_2Cl$, $C_4F_9OC_2H_5$, $C_7F_{13}OCH_3$, $C_7F_{13}OC_2H_5$, $C_8F_{15}OCH_3$, $C_8F_{15}OC_2H_5$, $C_{10}F_{21}OCH_3$, and $C_{10}F_{21}OC_2H_5$. Blends of one or more fluorinated ethers are also considered useful in practice of the invention.

Useful hydrofluoroether cooling and lubricating compositions may also comprise one or more perfluorinated compounds. Because a hydrofluoroether is most commonly more volatile than a perfluorinated fluid selected as a lubricious additive, a composition containing both a hydrofluoroether and a perfluorinated fluid preferably will comprise a minor amount, i.e., less than 50 weight percent of the perfluorinated fluid or fluids. Useful perfluorinated liquids typically contain from 5 to 18 carbon atoms and may optionally contain one or more caternary heteroatoms, such as divalent oxygen or trivalent nitrogen atoms. The term "perfluorinated liquid" as used herein includes organic compounds in which all (or essentially all) of the hydrogen atoms are replaced with fluorine atoms. Representative perfluorinated liquids include cyclic and non-cyclic perfluoroalkanes, perfluoroamines, perfluoroethers, perfluorocycloamines, and any mixtures thereof Specific representative perfluorinated liquids include the following: perfluoropentane, perfluorohexane, perfluoroheptane, perfluorooctane, perfluoromethylcyclohexane, perfluorotripropyl amine, perfluorotributyl amine, perfluorotriamyl amine, perfluorotrihexyl amine, perfluoro-N-methylmorpholine, perfluoro-N-ethylmorpholine, perfluoro-N-isopropyl morpholine, perfluoro-N-methyl pyrrolidine, perfluoro-1,2-bis (trifluoromethyl)hexafluorocyclobutane, perfluoro-2-butyltetrahydrofuran, perfluorotriethylamine, perfluorodibutyl ether, and mixtures of these and other perfluorinated liquids. Commercially available perfluorinated liquids that can be used in this invention include: Fluorinert™ FC-40, Fluorinert™ FC-43 Fluid, Fluorinert™ FC-71 Fluid, Fluorinert™ FC-72 Fluid, Fluorinert™ FC-77 Fluid, Fluorinert™ FC-84 Fluid, Fluorinert™ FC-87 Fluid, Fluorinert™ FC-8270, Performance Fluid™ PF-5060, Performance Fluid™ PF-5070, and Performance Fluid™ PF-5052. Some of these liquids are described in Fluorinert™ Electronic Fluids, product bulletin 98-0211-6086(212)NPI, issued 2/91, available from 3M Co., St. Paul, Minn. Other commercially available perfluorinated liquids that are considered useful in the present invention include perfluorinated liquids sold as Galden™ LS fluids, Flutec™ PP fluids, Krytox™ perfluoropolyethers, Demnum™ perfluoropolyethers, and Fomblin™ perfluoropolyethers.

In addition to one or more perfluorinated fluids, the hydrofluoroether compositions of the invention can, and typically will, include one or more conventional additives such as corrosion inhibitors, antioxidants, defoamers, dyes, bactericides, freezing point depressants, metal deactivators, and the like. The selection of these conventional additives is well known in the art and their application to any given method of cutting and abrasive working of metal is well within the competence of an individual skilled in the art.

One or more conventional base oils or other lubricious additives may also be appropriately added to the hydrofluoroether composition to optimize the lubricating nature of the composition. The most usefull additives will be volatile (i.e., have a boiling point below about 250° C.) though others are also considered useful. Useful auxiliary lubricious additives would include, for example: saturated and unsaturated aliphatic hydrocarbons such as n-decane, dodecane, turpentine oil, and pine oil; naphthalene hydrocarbons; polyoxyalkylenes such as polyethylene glycol; aromatic hydrocarbons such as cymene; thiol esters and other sulfur-containing compounds; and chlorinated hydrocarbons including oligomers of chlorotrifluoroethylene, chlorinated perfluorocarbons, and other chlorine-containing compounds. Also useful are load-resistive additives such as phosphates, fatty acid esters, and alkylene glycol ethers. These latter classes of compounds include trialkyl phosphates, dialkylhydrogen phosphites, methyl and ethyl esters of $C_{10}$ to $C_{20}$ carboxylic acids, esters of monoalkyl ether polyethylene or ethylene glycols, and the like. Representative load-resistive additives include triethylphosphate, dimethylhydrogenphosphite, ethyl caproate, polyethylene glycol methylether acetate, and ethylene glycol monoethylether acetate.

One or more partially fluorinated or perfluorinated alkylated lubricious additives may also be added to the hydrofluoroether compositions to further optimize the lubricious properties of the composition. Such additives typically comprise one or more perfluoroalkyl groups coupled to one or more hydrocarbon groups through a functional moiety. Suitable perfluoroalkyl groups consist of straight-chain and branched, saturated and unsaturated $C_4$–$C_{12}$ groups, and useful hydrocarbon groups include straight-chain and branched, saturated and unsaturated $C_{10}$–$C_{30}$ groups. Suitable functional linking moieties can be groups comprising one or more heteroatoms such as O, N, S, P, or functional groups such as $—CO_2—$, $—CO—$, $—SO_2—$, $—SO_3—$, $—PO_4—$, $—PO_3—$, $—PO_2—$, $—PO—$, or $—SO_2N(R)—$ where R is a short chain alkyl group.

The lubricating compositions of the invention may be applied for the cutting and abrasive working of metals using any known technique. For example, the hydrofluoroether-containing compositions may be applied in either liquid or aerosol form, can be applied both externally, i.e. supplied to the tool from the outside, or internally, i.e. through suitable feed provided in the tool itself.

The following examples are offered to aid in the understanding of the present invention and are not to be construed as limiting the scope thereof. Unless otherwise indicated, all parts and percentages are by weight.

EXAMPLES

Examples 1 to 16 and Comparative Examples C-1 to C-5

In each of the following Examples and Comparative Examples various fluids were tested for their ability to provide lubrication during a cutting operations and to dissipate heat from a metal workpiece and cutting tool. The lubricants were tested by drilling ½" (1.27 cm) diameter holes in a ¾" (1.9 cm) thick piece of type 304 stainless steel at a speed of 420 rpm and at a feed rate of 3 inches/minute (equivalent to 55 surface feet/minute or 1676 surface cm/min ) using a 0.25" peck program on an Excel™ 510 CNC machine. The drill bit was a 2-flute high speed steel (HSS) twist bit (available from CLE-Forge). For each Example and Comparative Example three through holes were drilled using each coolant lubricant fluid which was applied from a plastic squeeze bottle at a flow rate of about 30–35 mL/minute.

After the drill bit exited each completed hole, the drill was stopped and the temperatures of the drill bit and the workpiece (in the hole) were determined with a type K thermocouple fitted to an Omega (Model H23) meter. A new drill bit was used for each coolant lubricant tested. The machine load for each drilling operation was noted and averaged for the three trials. The work piece was then cleaned to remove residues left by the conventional lubricant and the surface finish of each hole was measured using a Hommel T500 profilometer. Passes of 0.5" made on each hole were averaged to determine $R_a$, measure of the surface roughness, and $R_{3z}$, and $R_{max}$, measures of the peak to valley height. Averaged data for each for each of the coolant lubricants tested, with the standard deviation, are shown in Table 1. In Examples 15 and 16 the tests were run using an Excel™ Model 510 CNC machine for two trials rather than three.

The fluids used in each of the Examples and Comparative Examples are as follows:

| Example | Description |
|---|---|
| 1 | $C_4F_9OCH_3$, commercially available from 3M as HFE ™-7100 |
| 2 | $C_4F_9OC_2H_5$, prepared as described in WO 96/22356 |
| 3 | $C_7F_{13}OCH_3$, prepared essentially as described in WO 96/22356 using perfluorocyclohexyl carbonyl fluoride and dimethyl sulfate |
| 4 | $C_7F_{13}OC_2H_5$, prepared essentially as described in WO 96/22356 using perfluorocyclohexyl carbonyl fluoride and diethyl sulfate |
| 5 | $C_2F_5CF(OCH_3)CF(CF_3)_2$, prepared as described in WO 96/22356 |
| 6 | $C_8F_{15}OCH_3$, prepared as described in WO 96/22356 using perfluoromethyl cyclohexyl carbonyl fluoride and dimethyl sulfate |
| 7 | $[(CF_3)_2CF]_2C = C(CF_3)OCH_2C_2F_4H$, available as Folitol ™-163 from the PERM branch of the State Institute of Applied Chemistry, St. Petersburg, Russian Federation |
| 8 | $CF_2CFHCF_2OCH_3$, commercially available from Fluorochem Ltd. |
| 9 | $C_4F_9OCH_2Cl$, prepared by the free radical chlorination of the compound of Example 1 |
| 10 | $C_4F_9OCH_3$ with 15 wt % Fluorinert ™ FC-40 Fluid, available from 3M Company |
| 11 | $C_4F_9OCH_3$ with 5 wt % $C_{10}H_{21}OC_9F_{17}$, prepared as described in EP 565118 |
| 12 | $C_4F_9OCH_3$ with 5 wt % Krytox ™ 157FSM perfluoropolyether available from DuPont |
| 13 | $C_4F_9OCH_3$ with 5 wt % Fomblin ™ Y25 perfluoropolyether available from Ausimont |
| 14 | $C_4F_9OCH_3$ with 5 wt % perfluoro polyepichlorohydrin, prepared as described in U.S. Pat. No. 5,198,139 (Bierschenk et al.) |
| 15 | $HC_2F_4OC_2F_4OC_2F_4H$, prepared as described in U.S. Pat. No. 5,476,974 Moore et al. |
| 16 | $HCF_2OC_2F_4OC_2F_4OCF_2H$, prepared essentially as described in U.S. Pat. No. 5,476,974 (Moore et al.) by the decarboxylation of $CH_3O(CO)CF_2OC_2F_4OC_2F_4OCF_2(CO)OCH_3$ |
| C-1 | Cimtech ™ 3900, an aqueous hydrocarbon emulsion, available from Cincinnati Milacron |
| C-2 | $CF_3CHFCHFC_2F_5$ available as Vertrel XF ™ from DuPont |
| C-3 | $C_6F_{13}H$ prepared by reduction of $C_6F_{13}SO_2F$ to the sulfinate with sodium sulfite, followed by thermal desulfinylation |
| C-4 | AK-225 ca/cb, a mixture of $C_2F_5CHCl_2$ and $CF_2ClCF_2CHFCl$, available from Asahi Glass |
| C-5 | Fluorinert ™ FC-40 Fluid, a perfluorinated trialkyl amine available from the 3M Company |

TABLE 1*

| Example | Bit Temp ° C. | Hole Temp ° C. | Machine Load (%) | $R_a$ ($\mu$M) | $R_{3z}$ ($\mu$M) |
|---|---|---|---|---|---|
| 1 | 102 (8) | 42 (7) | 80 | 5.44 (0.48) | 24.30 (2.71) |
| 2 | 83 (8) | 37 (3) | 71 | 4.88 (0.53) | 23.75 (2.08) |
| 3 | 67 (3) | 40 (3) | 70 | 6.27 (0.30) | 27.94 (2.46) |
| 4 | 76 (3) | 43 (2) | 70 | 6.40 (0.81) | 27.56 (2.59) |
| 5 | 88 (14) | 46 (7) | 75 | 6.12 (0.61) | 26.44 (1.55) |
| 6 | 85 (13) | 53 (6) | 73 | 6.12 (0.56) | 27.81 (5.38) |
| 7 | 70 (2) | 46 (3) | 68 | 4.72 (0.99) | 21.61 (4.11) |
| 8 | 82 (2) | 44 (3) | 73 | 6.27 (1.14) | 27.66 (3.25) |
| 9 | 67 (3) | 38 (1) | 64 | 4.80 (0.43) | 21.64 (2.49) |
| 10 | 89 (3) | 48 (0) | 75 | 5.51 (0.38) | 25.12 (3.53) |
| 11 | 65 (1) | 42 (2) | 71 | 4.80 (0.30) | 21.03 (2.72) |
| 12 | 74 (4) | 41 (2) | 68 | 4.75 (0.30) | 18.57 (1.98) |
| 13 | 72 (4) | 45 (2) | 69 | 5.18 (1.19) | 22.91 (3.73) |
| 14 | 70 (11) | 41 (2) | 68 | 4.80 (0.81) | 23.01 (3.73) |
| 15 | 92 (15) | 42 (4) | 58 | 2.64 (0.44) | 10.50 (2.24) |
| 16 | 93 (25) | 44 (6) | 52 | 4.93 (0.27) | 18.95 (1.18) |
| C-1 | 43 (0) | 44 (2) | 71 | 5.94 (0.51) | 25.98 (1.93) |

TABLE 1*-continued

| Example | Bit Temp ° C. | Hole Temp ° C. | Machine Load (%) | $R_a$ (μM) | $R_{3z}$ (μM) |
|---|---|---|---|---|---|
| C-2 | 126 (17) | 54 (9) | 91 | 7.72 (0.43) | 32.74 (3.71) |
| C-3 | 99 (14) | 50 (4) | 81 | 5.79 (0.13) | 26.31 (3.22) |
| C-4 | 77 (4) | 41 (2) | 65 | 4.19 (0.20) | 18.67 (1.75) |
| C-5 | 61 (2) | 47 (2) | 74 | 5.16 (0.43) | 23.57 (3.66) |

* Values in () are the standard deviations of triplicate drilling trials.

The neat hydrofluoroether coolant lubricant fluids (Examples 1–9 and 15–16) were successfully used as a coolant/lubricant fluid for drilling as shown by the equivalent or lower drill bit temperatures and surface finish numbers when compared to a hydrofluorocarbon fluid, Vertrel™ XF and $C_6F_{13}H$ (Comparative Examples C-2 and C-3). (The large variation noted for these materials was due to the increasing temperatures and increasing machine load with each hole drilled.) The hydrofluoroether fluids also performed as well as a perfluorinated fluid, FC-40™ (Comparative Example C-5), and the hydrochlorofluoroether (Example 9) outperformed the HCFC (Comparative Example C-4) in an analogous fashion.

Addition of lubricious additives to the hydrofluoroether $C_4F_9OCH_3$ (Examples 10 to 14) reduced bit temperatures and improved surface roughness significantly when compared to the neat fluid (Example 1), indicating that hydrofluoroether coolant lubricant performance can be further improved by adding small amounts of other lubricious materials.

The water based fluid used in Comparative Example C-1 was the most effective in keeping the drill bit and hole temperatures low and show that water improves the coolant properties of these preparations. The Cimtech™ fluid, however, did not produce an analogous improvement of the surface finish values or the machine load observed when compared to the neat hydrofluoroether fluid.

Examples 17 to 21 and Comparative Examples C-6 to C-9

In the following Examples 17 to 21 hydrofluoroether fluids were evaluated in endmilling of titanium and type 304 stainless steel. Comparative Examples C-6 to C-9 are included to indicate the performance expected with endmilling operations using a conventional lubricant, (Accu-Lube™, a hydrocarbon based lubricant available from ITW Fluid Products Group, Norcross, Ga.), or using no lubricant. Greenfield Industries, Chicago, Ill.), run at 30 SFM, at 3.5 inches per minute feed, and a depth of cut (DOC) of 0.175" in titanium and 30 SFM, 3.5 IPM, and a DOC of 0.1" in type 304 SS. A slot of about 3" (7.62 cm) was cut in the work pieces with coolant lubricant fluid applied from a squeeze bottle at flow rate of 35–40 mL/min. After the milling was completed the work pieces were cleaned to remove oily residues left by the Accu-Lube™ and the surface finish of the milled slots was measured with a Hommel T500™ profilometer, 0.2" path at 3 different positions. The data are shown in Table 2.

TABLE 2*

| | Workpiece | Lubricant | $R_a$ (μM) | $R_{3z}$ (μM) | $R_{max}$ (μM) |
|---|---|---|---|---|---|
| C-6 | Titanium | None | 3.20 (1.32) | 14.45 (5.36) | 30.50 (10.16) |
| C-7 | Titanium | Accu-lube ™ | 2.64 (0.10) | 10.34 (0.53) | 13.69 (1.40) |
| 17 | Titanium | $C_4F_9OCH_3$ | 1.60 (0.35) | 7.14 (1.47) | 13.06 (3.66) |
| 18 | Titanium | $C_4F_9OC_2H_5$ | 1.12 (0.30) | 5.23 (1.27) | 8.51 (3.68) |
| 19 | Titanium | $C_7F_{13}OCH_3$ | 0.91 (0.05) | 3.76 (0.15) | 6.30 (0.94) |
| C-8 | Titanium | FC-40 ™ | 1.35 (0.20) | 5.44 (0.56) | 8.46 (2.13) |
| C-9 | 304 SS | Accu-lube | 4.01 (0.02) | 15.62 (0.43) | 23.47 (1.14) |
| 20 | 304 SS | $C_4F_9OC_2H_5$ | 3.12 (0.25) | 12.37 (0.91) | 17.83 (0.66) |
| 21 | 304 SS | $C_7F_{13}OCH_3$ | 3.28 (0.68) | 12.60 (1.96) | 19.38 (4.88) |

*Values in () are the standard deviations of triplicate drilling trials.

FIG. 1 shows profilometer traces for the titanium endmilled work piece (Examples 17 to 19). The hydrofluoroether fluids (Examples 17 to 19) produced better surface finishes on the titanium than a conventional lubricant, Accu-lube™ (Comparative Example C-7) or with no lubricant applied (Comparative Example C-6). A perfluorinated coolant/lubricant fluid, FC-40™ (Comparative Example C-8), produced a surface finish equivalent to hydrofluoroether fluids. In addition, the Acculube™ slot required cleaning to remove oily residues after machining while the other fluids left no residue. Endmilling of stainless steel with hydrofluoroether fluids also produced a better surface finish than Acculube™.

Examples 22 to 25 and Comparative Examples C-10 and C-11

Examples 22 to 25 show the use of coolant lubricant fluids in endmilling of aluminum (type 6061), and cold rolled steel (CRS). Comparative Examples C-10 and C-11 are included to show the performance of a conventional lubricant (Boelube™, a hydrocarbon lubricant available from Orelube Corp., Plainview N.J.) in this operation. Using a Hurtco CNC™ milling machine, a slot was cut into the aluminum with a ½" two flute HSS mill run at 20 IPM feed (50.8 cm/min), 1700 rpm, 220 surface feet/min or 6706 surface cm/min, ⅛" (0.32 cm) depth of cut using each coolant lubricant fluid. The workpiece was cleaned to remove oil residues left from the Boelube™. No residue was noted for the hydrofluoroether fluids. Surface roughness was measured using a Hommel T500™ profilometer with a 0.2" measurement path at three different positions in the slot. These were averaged and are reported in Table 3.

TABLE 3*

| Example | Metal Workpiece | Coolant Lubricant | $R_a$ (μM) | $R_{3z}$ (μM) | $R_{max}$ μM |
|---|---|---|---|---|---|
| C-10 | Cold Rolled Steel | Boelube ™ | 6.60 (0.81) | 23.11 (2.13) | 30.94 (1.62) |
| 22 | Cold Rolled Steel | $C_4F_9OCH_3$ | 4.70 (0.36) | 19.23 (1.40) | 28.55 (2.21) |
| 23 | Cold Rolled Steel | $C_7F_{13}OCH_3$ | 4.01 (0.48) | 16.08 (2.16) | 23.82 (4.24) |
| C-11 | 6061 Aluminum | Boelube | 1.65 (0.08) | 7.49 (0.48) | 10.54 (0.84) |
| 24 | 6061 Aluminum | $C_4F_9OCH_3$ | 1.62 (0.15 | 6.91 (0.64) | 10.11 (0.64) |
| 25 | 6061 Aluminum | $C_7F_{13}OCH_3$ | 1.55 (0.13) | 6.55 (0.51) | 9.78 (1.04) |

*Values in () are the standard deviations of triplicate drilling trials.

The hydrofluoroether fluids improved the surface finish of the milled slot in cold rolled steel (Examples 22 and 23) over that produced using Boelube™ (Comparative Example C-10). The results of milling the soft aluminum indicate that there was no significant difference between surfaces produced with any of the tested fluids (Examples 24 and 25 and Comparative Example C-11). The Boelube™, however, left an oily residue while the others were residue free.

Example 26 to 29 and Comparative Examples C-12 to C-15

Examples 26 to 29 show the use of hydrofluoroether coolant/lubricant fluids in drilling aluminum. Comparative Examples C-12 to C-15 allow comparison with known coolant lubricant fluid formulations. Using a Hurtco™ CNC machine, three through holes were drilled in a 1" thick block of aluminum 2024-T3, at 1000 rpm (130 surface feet/min, about 3960 surface cm/min) and 8" per minute with a ½" high speed stainless 2 flute bit for each coolant lubricant fluid. The test fluids were delivered from a squeeze bottle to the drill bit and hole at a flow rate of about 35–40 nL/min. After the drilling was complete, the block was cut through the drilled holes so that they could be examined in cross section. To remove the residual lubricant from the Boelube and the sawing process, the test pieces were cleaned prior to measuring surface roughness with a Perthometer™ MP4. Each cross sectioned hole half was measured and the results averaged and recorded in the Table 4. In Table 4, FC-71™ and FC-40™ are perfluorinated fluids available from 3M, Vertrel™ XF is a hydrofluorocarbon of the structure $CF_3CHFCHFC_2F_5$ available from DuPont, and Boelube™ is a hydrocarbon lubricant available from Orelube Corp., Plainview N.J.

The use of volatile hydrofluoroether coolant lubricant fluids and hydrofluoroether based formulations containing other volatile additives (Examples 26 to 29) produced better surface finishes than other volatile CFC- and HCFC-based mixtures with the same additives (Comparative Examples C-12 and C-13). A volatile perfluorinated fluid, FC-40™, was equivalent to these hydrofluoroether based mixtures. Comparative Example C-15, using Boelube™, left an oily residue on the workpiece.

Various modifications and alterations of this invention will be apparent to those skilled in the art without departing from the scope and spirit of this invention, and it should be understood that this invention is not limited to the illustrative embodiments set forth herein.

We claim:

1. A method of cutting on abrasively treating a metal or ceramic workpiece comprising applying to said workpiece a composition comprising a hydrofluoroether and cutting or abrasively treating the workpiece, wherein the workpiece is left without residue of the composition following the treatment.

2. The method of claim 1 wherein said application is made prior to the cutting or abrasive treatment of the workpiece.

3. The method of claim 1 wherein said application is made during the cutting or abrasive treatment of the workpiece.

4. The method of claim 1 wherein the hydrofluoroether is selected according to the formula:

$$(R_1—O)_n—R_2$$

wherein:

n is a number from 1 to 3 inclusive;

$R_1$ and $R_2$ are the same or are different from one another and are selected from the group consisting of substi-

TABLE 4*

| Example | Coolant Lubricant | $R_a$ (μM) | $R_{3z}$ (μM) | $R_{max}$ (μM) |
|---|---|---|---|---|
| 26 | $C_4F_9OCH_3$ | 2.21 (0.48) | 10.10 (3.05) | 13.87 (3.78) |
| 27 | $C_7F_{13}OCH_3$ | 1.73 (0.43) | 8.66 (2.64) | 13.11 (5.00) |
| 28 | 1.5 wt % butyl Cellosolve ™ in $C_4F_9OCH_3$ | 1.80 (0.33) | 7.82 (1.12) | 11.18 (2.77) |
| 29 | 10 wt % FC-71 ™ in $C_4F_9OCH_3$ | 1.80 (0.46) | 8.53 (1.32) | 10.74 (1.75) |
| C-12 | 1.5 wt % butyl Cellosolve in CFC 113 | 2.77 (0.07 | 10.31 (0.58) | 10.90 (0.61) |
| C-13 | 1.5 wt % butyl Cellosolve in Vertrel ™ XF | 3.00 (0.15) | 11.68 (0.53) | 12.90 (1.14) |
| C-14 | FC-40 ™ | 1.75 (0.36) | 8.15 (0.99) | 11.40 (1.90) |
| C-15 | Boelube ™ | 1.32 (0.41) | 5.94 (1.57) | 7.14 (1.62) |

*Values in () are the standard deviations of triplicate drilling trials.

tuted and unsubstituted alkyl, aryl, and alkylaryl groups and their derivatives;

with the proviso that at least one of said $R_1$ and $R_2$ contains at least one fluorine atom, and at least one of $R_1$ and $R_2$ contains at least one hydrogen atom;

and further wherein one or both of $R_1$ and $R_2$ may contain one or more catenary or noncatenary heteroatoms; may contain one or more functional groups; may be linear, branched, or cyclic; may contain one or more unsaturated carbon-carbon bonds; and may contain one or more chlorine atoms with the proviso that where such chlorine atoms are present there are at least two hydrogen atoms on said $R_1$ and/or $R_2$ group.

5. The method of claim 1 wherein the hydrofluoroether is selected according to the formula:

$$R_f—O—R$$

wherein:

$R_f$ contains at least one fluorine atom and is selected from the group consisting of substituted and unsubstituted alkyl, aryl, and alkylaryl groups and their derivatives;

R contains no fluorine atoms and is selected from the group consisting of substituted and unsubstituted alkyl, aryl, and alkylaryl groups and their derivatives.

6. The method of claim 1 wherein the hydrofluoroether is selected from the group consisting of: $C_3F_7OCH_3$, $C_3F_7OC_2H_5$, $C_4F_9OCH_3$, $C_4F_9OCH_2Cl$, $C_4F_9OC_2H_5$, $C_7F_{13}OCH_3$, $C_7F_{13}OC_2H_5$, $C_8F_{15}OCH_3$, $C_8F_{15}OC_2H_5$, $C_{10}F_{21}OCH_3$, and $C_{10}F_{21}OC_2H_5$.

7. The method of claim 1 wherein said composition further comprises a perfluorinated compound.

8. The method of claim 1 wherein said composition further comprises one or more perfluorinated compounds selected from the group consisting of: perfluoropentane, perfluorohexane, perfluoroheptane, perfluorooctane, perfluoromethylcyclohexane, perfluorotripropyl amine, perfluorotributyl amine, perfluorotriamyl amine, perfluorotrihexyl amine, perfluoro-N-methylmorpholine, perfluoro-N-ethylmorpholine, perfluoro-N-isopropyl morpholine, perfluoro-N-methyl pyrrolidine, perfluoro-1,2-bis (trifluoromethyl)hexafluorocyclobutane, perfluoro-2-butyltetrahydrofuran, perfluorotriethylamine, and perfluorodibutyl ether.

9. The method of claim 1 wherein said composition further comprises lubricious additive.

10. The method of claim 9 wherein said lubricious additive is selected from the group consisting of: saturated and unsaturated aliphatic hydrocarbons; naphthalene hydrocarbons; polyoxyalkylenes; aromatic hydrocarbons; thiol esters; oligomers of chlorotrifluoroethylene; chlorinated hydrocarbons; chlorinated perfluorocarbons; phosphates; fatty acid esters; and alkylene glycol esters.

11. The method of claim 9 wherein said lubricious additive is selected from the group consisting of fluorinated alkylated compounds comprising one or more perfluoroalkyl groups coupled to one or more hydrocarbon groups through a functional moiety.

* * * * *

UNITED STATES PATENT AND TRADEMARK OFFICE

CERTIFICATE OF CORRECTION

PATENT NO. : 6,043,201
DATED : March 28, 2000
INVENTOR(S) : Dean S. Milbrath et al.

It is certified that error appears in the above-identified patent and that said Letters Patent is hereby corrected as shown below:

Column 2,
Line 49, please delete "prccious" and insert in place thereof -- precious --.

Column 3,
Line 26, please delete "dcrivativc" and insert in place thereof -- derivative --.
Line 56, please delete "thereof Specific" and insert in place thereof -- thereof. Specific --.

Column 6,
Line 2, please delete "for each" in the first instance.

Column 7,
Line 10, please delete "()" and insert in place thereof -- ( ) --.

Column 8,
Line 3, before the word "Greenfield" please insert -- The fluids were tested with a Bridgeport milling machine run with a 5/8" (1.59 cm) four flute HSS end mill (#A-16 from --.
Line 32, please delete "()" and insert in place thereof -- ( ) --.

Column 9,
Line 14, please delete "()" and insert in place thereof -- ( ) --.
Line 37, please delete "nL/min." and insert in place thereof -- mL/min. --.
Last line of Table IV): please delete "()" and insert in place thereof -- ( ) --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*